United States Patent [19]

Felsenthal

[11] 4,261,627

[45] Apr. 14, 1981

[54] COLLAPSIBLE DRAWER-RECEIVING CABINET

[76] Inventor: James M. Felsenthal, 5428 Collingwood Cove, Memphis, Tenn. 38117

[21] Appl. No.: 72,587

[22] Filed: Sep. 5, 1979

[51] Int. Cl.[3] ..... A47B 43/00; F16M 11/38

[52] U.S. Cl. ..... 312/258; 312/259; 312/6; 248/166

[58] Field of Search ..... 312/258, 259, 5, 6; 108/11; 248/166

[56] References Cited

U.S. PATENT DOCUMENTS

| | | | |
|---|---|---|---|
| 944,063 | 12/1909 | Warren | 312/259 |
| 1,602,410 | 10/1926 | Hamblin | 312/258 |
| 1,732,510 | 10/1929 | Gray | 312/258 |
| 2,550,959 | 5/1951 | Bowman | 312/258 |
| 3,279,873 | 10/1966 | Gronquist | 312/259 |
| 3,375,935 | 4/1968 | Whyte | 312/259 |
| 3,576,355 | 4/1971 | Stone | 312/258 |
| 3,628,842 | 12/1971 | Wright | 312/259 |
| 3,892,348 | 7/1975 | Rohner | 312/259 |
| 3,933,401 | 1/1976 | Lampe et al. | 312/258 |
| 4,080,023 | 3/1978 | Bair | 312/259 |

FOREIGN PATENT DOCUMENTS

| | | | |
|---|---|---|---|
| 926322 | 5/1973 | Canada | 312/259 |
| 2124160 | 11/1972 | Fed. Rep. of Germany | 312/259 |
| 1223185 | 2/1971 | United Kingdom | 312/258 |

*Primary Examiner*—Victor N. Sakran
*Attorney, Agent, or Firm*—S. B. Wiczer

[57] ABSTRACT

A drawer-receiving chest or cabinet stored and shipped as a unit in collapsed folded-flat form and erectible by unfolding to a sturdy structure having several openings for slidably-receiving and supporting drawers, as a chest of drawers, cabinet or the like, and having a one-piece back panel to which is hingedly fastened all of the structural elements to form a unitary structure, including a forward framework defining drawer openings and drawer-supporting shelves hingedly connected to the back panel; and side and top panels respectively hingedly connected to the vertical edges of the back panel and the top panel hingedly connected both to the top edge of the back panel and to the forward framework, thus allowing the sides and top to be unfoldable forward from the back panel to define sides and top encasing said framework, with the side elements carrying foldable flaps on the forward edge of each side and folding horizontally inward about a vertical frame element to firmly secure the total structure into an erected drawer-supporting assembly, without need for and free of other fastening elements, such as screws, nails or the like, the flaps rigidly maintaining the cabinet as a strong drawer-supporting piece of furniture.

7 Claims, 8 Drawing Figures

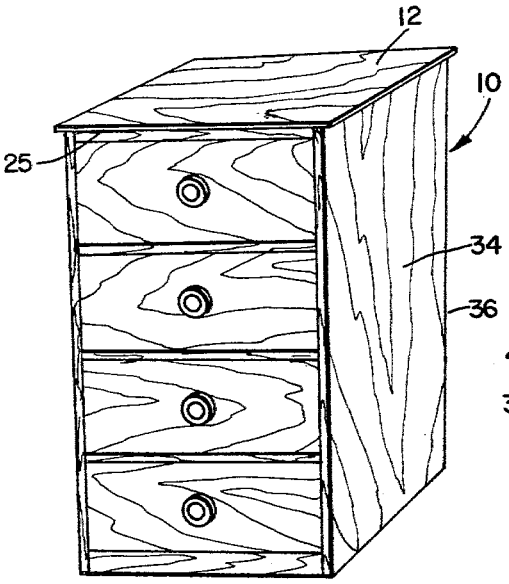
Fig.1
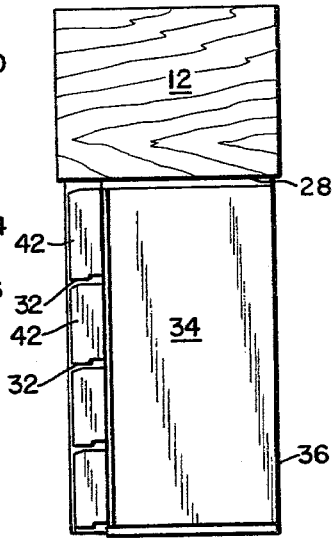
Fig.2
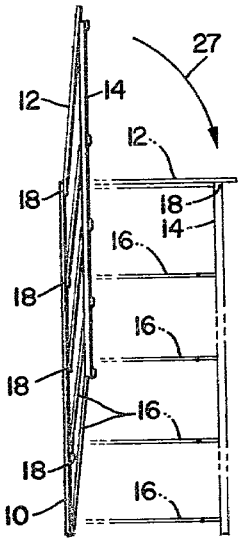
Fig.3
Fig.4
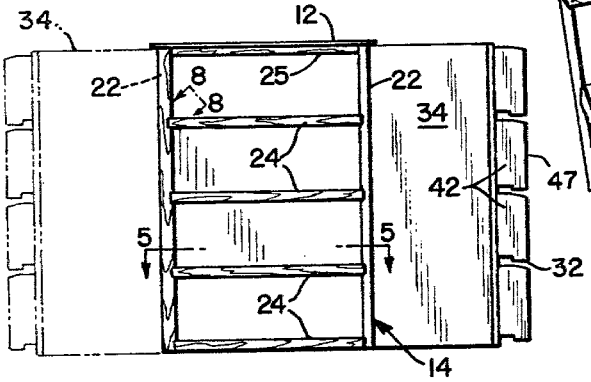
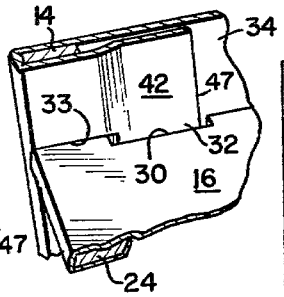
Fig.8
Fig.6
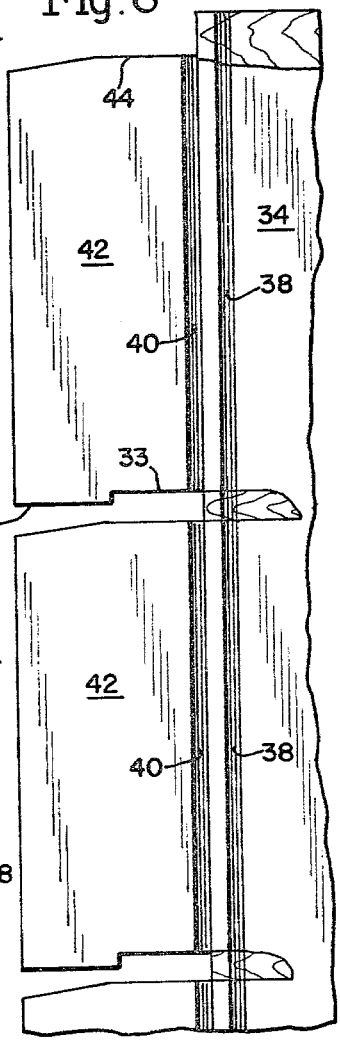
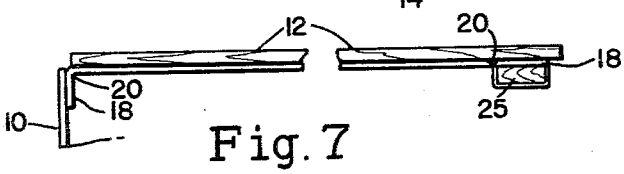
Fig.7
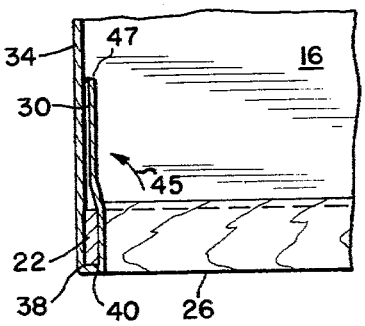
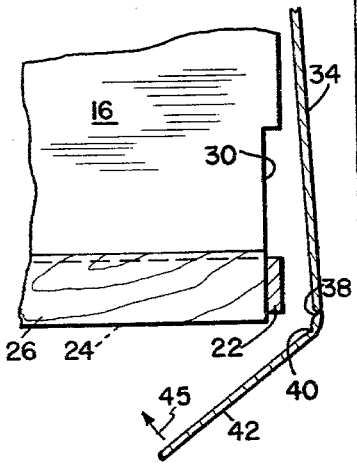
Fig.5

COLLAPSIBLE DRAWER-RECEIVING CABINET

This invention relates to foldably collapsed and erectible furniture, such as a drawer-receiving chest or cabinet, which may be formed as a single unit of strong light-weight structural materials, foldably shipped or stored as hinged-together elements comprising flat panel-like sheets fastened to a collapsible and erectible drawer-supporting frame, which becomes enclosed in erected rigidly secure position by back, top and sides fastenable about the frame by foldable flaps.

More particularly, the invention relates to erectible and collapsible furniture, flat-folded into a small space for shipment and erectible to expanded functional furniture size as a unit of several elements to form a drawer-receiving chest, cabinet, or the like. In erected unfolded form the article is a piece of strong and rigid furniture secured together by the folded flaps, without need for fastening elements of the character of metallic nails, screws, or fasteners of any type to rigidly maintain the erected cabinet functional as a strong drawer-supporting furniture piece.

The invention has numerous advantages over the prior collapsible furniture art. The present invention provides a frame and hinged-together panels as "one piece" of foldable elements having a main unitary back panel support, which is usually a strong sheet-like panel, hingedly fastened to a collapsible forward framework forming drawer-receiving openings and drawer-supporting bottom panel-like elements, and which has sides and top panel elements hinged respectively to the vertical sides and top edge of the back panel with the forward top edge also hinged to the top of the forward frame element, to form a single strong, but foldable furniture unit. The drawer-supporting chest hereof can be unfolded and erected from the collapsed state in which it requires little storage space, occupied only by the back, folded sides and hinged and collapsed forward frame all lying folded against the back, and which is erectible to a normal large space occupying drawer-receiving chest or dressing table having drawers or the like.

The frame has vertical support members or legs secured together by horizontal crosspiece and panels. Drawer support panels are disposed at each crosspiece height and hinged thereto at each forward panel edge and to the rear panel at each after drawer-supporting panel edge, thus to allow the forward frame and the back hinged to each of the drawer-support panels to fold flat against the back panel in collapsed position. The side panel elements each carry foldable flaps which fold horizontally about the vertical support members at each drawer opening level defined by a drawer-support panel, bending inwardly to secure and reinforce the drawer sides and are sized to engage the surfaces of the horizontal drawer-support panels frictionally upon folding and to lock the fully expanded structure into the desired strong chest of drawers or the like. The lower flap edge of each flap fits into and is secured in folded and locked position in a retaining groove or into a cutaway portion between each drawer-supporting panel side and large panel of the side. The flaps are dimensioned as foldable flaps to be bent about each vertical leg in the drawer opening level, and which is retained in locked manner in the groove as will appear, firmly securing the chest or cabinet in functional erected position, there being no need for other small fastening such as metallic elements to fasten the structure in strong erected form such as nails, screws, lock fasteners, or the like.

Overall, the structure hereof has the further distinct advantage over prior constructions in that no particular skill is needed to unfold the collapsed structure to normal size, turning each element to erected position on its hinges, and by mere folding of the panels and flaps about the separated expanded framework, the unit is easily locked by manually bending the flaps into a strong useful structure. It is thus both a unitary one-piece structure erectible and collapsible without need for fastening or unfastening of frame fastening elements, such as screws or nails.

The invention is further described by reference to the drawings in which:

FIG. 1 illustrates the final erected structure in functional form with drawers slidably mounted in each drawer-receiving space, as chest of drawers;

FIG. 2 is an elevational rear view of the assembly in collapsed position;

FIG. 3 illustrates schematically in side elevation the hinged change from collapsed support of the frame, drawer support elements and rear panel and their movement to erected position;

FIG. 4 is a front elevation of the partially erected unit with both large side panels in open ready to fold to erect position;

FIG. 5 is a section in plan taken on the lines 5—5 of FIG. 4 the left hand portion illustrating a detail of the folded side flap in locked position, and the right hand portion the plan view of the drawer support base and locking groove to lock a side flap therein;

FIG. 6 is a detail showing the structure of locking side flaps positioned between drawer openings, available for folding and locking the sides and assembly into erected structure position.

FIG. 7 is a detail of a fastening strip as the hinging element and bearing hinge fold lines for hinged fastening of a panel to a top, back or front cross frame elements; and FIG. 8 is a detail showing the mounting of a flap within a securing slot.

Referring to FIGS. 1–4 and 7, a base structional element is provided in a strong, preferably single piece and unitary, back panel 10, and a forward frame element 14. A top 12 is foldably hinged at the tops of the frame and panel, both front and rear, to fold from collapsed or folded position at the left side, to open position, at the right side as shown in FIG. 3. The top 12, rear panel 10 and forward frame element 14 are also hingedly secured together by horizontal drawer supporting panels 16. The panels 16 are fastened at their ends to the face of the rear panel 10 by flexible hinges formed as gluing strips 18 having shallow fold lines 20 cut therein, as shown in FIG. 7. The bent horizontal portion of a hinge strip 18 is glued to a bottom near the rear edge of a panel 16, and the other remaining strip portion is glued to a back panel surface to form the hinge by bending on the fold line 20, thus to allow hinged back, top and panel movement therebetween from collapsed to erect positions as shown diagrammatically in FIG. 3.

The forward frame element 14, as shown in FIGS. 3 and 4 are formed of vertical legs or strips comprising support pieces 22 secured together by horizontal frame crosspiece 24 fastened thereto, one beneath each drawer height level and notched or mortised therein for secure fastening as by gluing together as a framework. The upper crosspiece 25, above the upper drawer opening A supports the top 12 as hinged thereto at the forward top end and hinged to the upper edge of the panel 10 at the rear end. The other crosspieces 24 as shown in FIG. 5 are secured each to a forward edge of the drawer supporting panels 26, a portion of each panel being bent therearound to form a forward panel supporting end. The panel 16 carries a forward fold line 28 in one of the surfaces, usually lower, of a support panel 16, thus to provide a forward hinge to accommodate the folding movement of the front frame against the panels. The upper cross support 25, as shown in FIGS. 1 and 4, alone has the top glued thereto by a gluing strip 18 hinge at the forward frame edge.

In that manner the frame is movable on its hinging elements bending on hinge lines 20 and 28, rear and front respectively, to fold the collapsed position shown in the left hand portion of FIG. 3; and will open, unfolding in the direction of the arrow 27 to the erected position shown at the right hand of FIG. 3. In that erected position, the total assembly may then be folded into layers of flat-folded frame and panels, occupying little flat-folded space changeable by erecting to the open position to occupy a much larger rectangular space as shown in FIGS. 1 and 3.

In locking of the structure into erected position each flap 42 is bent inward at the drawer opening of the same level on its fold lines 38 and 40 about a vertical leg portion 22 in the direction of the arrow 45 and in folding movement bears across the upper surface of a drawer support panel 16. Pressing the flap 42 to parallel position against a side panel 34, as shown in FIG. 5, allows the locking ear 32 of the flap 42 to enter the groove 30 and will be retained secure therein as shown in FIG. 8. The composite of flaps, each bent in around a leg 22 at the drawer opening level secures a side panel 34 firmly about the vertical post 22 in erected position with all the bottom flap portions 32 each entering a groove 30 and remains locked and retained therein. Thus the entire assembly becomes secured together ruggedly and firmly in a locked erected position without need for any small fastening elements such as nails, screws, metallic fasteners as conventionally used in the art to secure functional elements together, and the present procedure requires substantially little skill to erect the unit to sturdy functional erect position.

For disassembly and returning to folded position, the inner edge 47 of a flap is manually merely gripped and pulled in a reverse bend, and the sides refolded across the back panel 10 and the frame and drawer panels refolded on its hinges to the collapsed position of FIG. 3, thus folding for storage or shipment as desired in the greatly reduced space.

The entire structure can be formed of paper box board such as paper board reinforced with a corrugated inner panel or a similar structure, or even fiber reinforced plastic and equivalent, preferably light weight panel materials, can be used. Such paneling can be coated only with a wood or plastic veneer as an outer laminar layer coating adhered to an inner sheet such as paper board, both for strength and for enhancing the appearance as simulated wood furniture. Other decorative effects may be achieved by other coating and surface ornamentation including embossing or engraving or application of decals, other plastic or fabric sheet materials desirably printed, designed or ornamented, may also be used on the panel surfaces.

It is preferred that the entire panel structure also be formed most economically of paper board such as corrugated box board, and the hinging elements may be glued to the surfaces as adhesive strips which may be reinforced with elongated fibers laid in the adhesive for great hinge and securing strength in the structure described. However, other types of hinging elements including merely shallow-cut bend lines and still other, less desirably, of known mechanical hinge types may be substituted as hinging elements with considerable reduction in economy.

The forward frame elements both vertical support legs and cross bars can be made of wood, fiber reinforced plastic as well as light metal or other light weight materials.

As thus described, an improved furniture piece such as a cabinet chest of drawers, or the like, and having other utilities, as will be apparent to one skilled in the art, which has formed a unitary hinged-together series of panels and a forward framework, which is erectible from collapsed flat position by merely hingedly unfolding the panels and frame from the flat position in which they are stored or shipped to a large expanded structure. The erected open receiving drawer structure is secured in the functional position by bent-in horizontal flap elements carried by the side panels and easily locked about vertically supported legs to firmly secure the structure in erected position.

Certain modifications will occur to those skilled in the art and accordingly it is intended that the detailed description hereof be regarded as exemplary and not limiting except as defined in the claims.

I claim:

1. A substantially flat-foldable and erectible to a comparatively large space furniture piece of the character of a rugged drawer-supporting chest of drawers, cabinet, or the like secured in erected position by self-securing laterally foldable flaps without use of tools or fasteners such as screws, bolts, nails, clips or the like, comprising a unitary back panel foldably hinged as one piece to each of a rectangular forward frame, top and sides, said forward frame being formed of wooden stiffening strips or their structural equivalent and comprising vertical side supporting legs extending approximately from top to bottom and fastened to a plurality of horizontal cross frame pieces disposed below each drawer level for horizontal support of a drawer therein and securing said vertical legs into a rigid frame, means hinged at their forward edges to said cross frame pieces and at their rear ends to said back panel by hinging elements comprising flexible strips, partial scoring lines or rigidly mounted hinge elements or the like providing hinged folding support for said frame against said back panel in folded position and horizontal sliding support for the drawers in erected drawer-supporting position, each of said sides having a vertically disposed series of said self-securing flaps supported from a forward side edge, each flap being foldable horizontally about a vertical leg into a drawer opening and secured therein, the combined self-securing flaps in said folded position serving as the sole locking means for the erected assembly.

2. The furniture piece as defined in claim 1 wherein said hinged frame folding support comprises a series of panels each hinged at a forward edge to the cross frame piece and at a rear edge against said back panel by a flexible strip and the flap and sides are hinged to the back and sides by score lines cut therebetween, whereby the forward frame and panels fold hingedly against said back panel in folded position and each panel lies horizontally level beneath a drawer opening as a drawer support element in erected position.

3. The furniture piece as defined in claim 1 wherein each lateral edge of said hinged folding support elements are disposed at least partially spaced inward from said folded sides to form a groove therebetween in erected position, and said self-securing flaps are each bent around a vertical leg and to lie against the supporting side, each flap having a lower depending ear portion to engage and lie within said groove securing said flap and side as a locking means supporting, in combination with other flap members, the entire assembly in firmly locked erected position.

4. The furniture piece as defined in claim 1 wherein said top is foldably hinged both to the back panel and upper frame cross frame piece to lie flat over the top of the assembled unit in erected position said cross frame piece supporting said top in erected position, and in a plane approximately that of the back panel in flat-folded position.

5. The furniture piece as defined in claim 1 wherein the panels are formed of materials selected from the group consisting of paperboard and plastic.

6. The furniture piece as defined in claim 5 where the panel material carries a veneer sheet including surface decorations to attractively simulate a furniture piece.

7. A substantially flat-foldable and erectible to a comparatively large space-occupying furniture piece of the character of a drawer-receiving and supporting chest of drawers, cabinet, or the like secured in erected position by self-locking laterally foldable flaps without use of tools or fasteners such as screws, bolts, nails, clips or the like, comprising a unitary back panel hinged as one piece to two side panels foldable across the back in folded position and each about one side in erected position, to a forward frame formed of wooden stiffening strips or their structural equivalent, comprising a pair of vertical supporting legs extending from top to bottom secured together by a plurality of horizontal cross frame pieces vertically spaced to define supports for the top and a plurality of rectangular drawer-receiving openings and securing said legs into a rigid forward frame member, to drawer support shelves hinged at each forward edge to a cross frame piece beneath the drawer opening and at each rear edge to the back panel for horizontal sliding support of drawer therein, and to a top panel member hinged both at a point near a forward edge to the top cross frame piece of said forward frame and to the top edge of said back panel, whereby the entire assembly is hinged together by hinging elements comprising flexible strips, partial scoring lines or rigidly mounted hinge elements into a single furniture unit both in folded and erected positions, said side panel members being folded forward to define sides of said furniture piece in erected position, each side panel having a vertically disposed series of flaps on each forward side edge, said flaps being spaced vertically and horizontally bent about a vertical leg into a drawer-receiving opening to lie against a side panel member as a folded parallel wall lining the interior of the drawer opening at each side, said drawer supporting shelves having a cut-away portion at each lateral edge to define with an adjacent side member a flap locking slot, said flaps each having a depending ear portion entering one of the said slots, whereby the series of bent flaps each with a lower ear portion held in a slot secures said side panel members and the hinged assembly as an erected furniture piece in stable erected position.

* * * * *